US008404059B2

(12) United States Patent
Wada et al.

(10) Patent No.: US 8,404,059 B2
(45) Date of Patent: Mar. 26, 2013

(54) ALUMINUM ALLOY FOR ANODIZING HAVING DURABILITY, CONTAMINATION RESISTANCE AND PRODUCTIVITY, METHOD FOR PRODUCING THE SAME, ALUMINUM ALLOY MEMBER HAVING ANODIC OXIDE COATING, AND PLASMA PROCESSING APPARATUS

(75) Inventors: Koji Wada, Kobe (JP); Jun Hisamoto, Kobe (JP); Toshiyuki Tanaka, Inabe (JP); Kozo Hoshino, Moka (JP); Kazunori Kobayashi, Moka (JP)

(73) Assignee: Kobe Steel, Ltd., Kobe-shi (JP)

( * ) Notice: Subject to any disclaimer, the term of this patent is extended or adjusted under 35 U.S.C. 154(b) by 318 days.

(21) Appl. No.: 12/374,798

(22) PCT Filed: Jul. 10, 2007

(86) PCT No.: PCT/JP2007/063752

§ 371 (c)(1),
(2), (4) Date: Jan. 23, 2009

(87) PCT Pub. No.: WO2008/018262

PCT Pub. Date: Feb. 14, 2008

(65) Prior Publication Data

US 2010/0018617 A1 Jan. 28, 2010

(30) Foreign Application Priority Data

Aug. 11, 2006 (JP) ..... 2006-220387

(51) Int. Cl.
*C22C 21/08* (2006.01)

(52) U.S. Cl. ..... 148/415; 148/688; 420/544; 118/723 R

(58) Field of Classification Search ..... 148/415, 148/688; 420/544; 118/723 R
See application file for complete search history.

(56) References Cited

U.S. PATENT DOCUMENTS

| | | | | |
|---|---|---|---|---|
| 4,605,448 | A * | 8/1986 | Baba et al. | 148/537 |
| 6,027,629 | A * | 2/2000 | Hisamoto et al. | 205/50 |
| 2009/0050485 | A1 | 2/2009 | Wada et al. | |

FOREIGN PATENT DOCUMENTS

| | | | |
|---|---|---|---|
| JP | 7 126890 | | 5/1995 |
| JP | 07126890 | A * | 5/1995 |
| JP | 10 88271 | | 4/1998 |

(Continued)

OTHER PUBLICATIONS

"Aluminum and Aluminum Alloys", ASM International, 1993, p. 13.*

*Primary Examiner* — Roy King
*Assistant Examiner* — Janelle Morillo
(74) *Attorney, Agent, or Firm* — Oblon, Spivak, McClelland, Maier & Neustadt, L.L.P.

(57) ABSTRACT

The aluminum alloy for anodic oxidation treatment directed to the present invention comprises as alloy elements 0.1 to 2.0% Mg, 0.1 to 2.0% Si, and 0.1 to 2.0% Mn, wherein each content of Fe, Cr, and Cu is limited to 0.03 mass % or less, and wherein the remainder is composed of Al and inevitable impurities. An aluminum alloy more excellent in the durability can be obtained by subjecting the aluminum alloy ingot having the above element composition to a homogenization treatment at a temperature of more than 550° C. to 600° C. or less. An aluminum alloy member can be obtained by forming an anodic oxidation coating on the surface of the aluminum alloy.

19 Claims, 2 Drawing Sheets

FOREIGN PATENT DOCUMENTS

| | | |
|---|---|---|
| JP | 11 001797 | 1/1999 |
| JP | 11 140690 | 5/1999 |
| JP | 2900820 | 6/1999 |
| JP | 2900822 | 6/1999 |
| JP | 11 229185 | 8/1999 |
| JP | 2943634 | 8/1999 |
| JP | 2000 282294 | 10/2000 |
| JP | 2001 220637 | 8/2001 |
| JP | 3249400 | 1/2002 |
| JP | 2002 241992 | 8/2002 |
| JP | 2002 256488 | 9/2002 |
| JP | 2003 119539 | 4/2003 |
| JP | 2003 119540 | 4/2003 |
| JP | 2003 171727 | 6/2003 |
| JP | 2004 099972 | 4/2004 |
| JP | 3746878 | 2/2006 |

* cited by examiner

ALUMINUM ALLOY FOR ANODIZING HAVING DURABILITY, CONTAMINATION RESISTANCE AND PRODUCTIVITY, METHOD FOR PRODUCING THE SAME, ALUMINUM ALLOY MEMBER HAVING ANODIC OXIDE COATING, AND PLASMA PROCESSING APPARATUS

TECHNICAL FIELD

The present invention relates to: an aluminum alloy suitable for an anodic oxidation treatment, which is preferably utilized as a material for a vacuum chamber used in a plasma processing apparatus, such as the production equipment for semiconductors and liquid crystals, and for components equipped inside the vacuum chamber; a method for producing the aluminum alloy; and an aluminum alloy member in which an anodic oxidation coating is formed on the surface of the aluminum alloy.

BACKGROUND ART

Conventionally, anodic oxidation treatments have been frequently used, in which an anodic oxidation coating is formed on the surface of an aluminum alloy, a substrate, such that the corrosion resistance (the corrosion resistance to hot gases) and the wear resistance or the like are provided to the substrate. For example, a vacuum chamber used in a plasma treatment apparatus of the semiconductor production equipment and various components equipped inside the vacuum chamber, such as an electrode, are mainly formed by an aluminum alloy; however, the corrosion resistance and the wear resistance thereof cannot be maintained as far as the aluminum alloy is of a solid aluminum alloy. Therefore, an anodic oxidation treatment is typically performed on the substrate made of an aluminum alloy so that an anodic oxidation coating (hereinafter, sometimes simply referred to as a "coating") is formed on the surface of the substrate. That is why, inside the vacuum chamber, the certain processing is performed on a member to be treated, such as silicon wafer, by using various types of corrosive gases and plasmas under a high temperature environment ranging from room temperature to 200° C. or more, in a pretreatment process or a production process of the semiconductor production; thereby the inner face of the vacuum chamber and the various components equipped inside the vacuum chamber, such as a plasma electrode, are exposed to the environment stated above, resulting in that the corrosion resistance and the wear resistance thereof cannot be maintained as far as the aluminum alloy is of a solid aluminum alloy.

As aluminum alloy members in which the above anodic oxidation coating is formed, many members are proposed in which commercially available aluminum alloys, such as an Al—Mg based alloy (JIS A5000 series) and an Al—Mg—Si based alloy (JIS A6000 series), are used as substrates (see, for example, Patent Documents 1 to 7). However, in recent years, the gaseous environments adopted have been more severe due to increased temperatures of the gases and the high-density growth of plasmas, as semiconductors have been highly integrated; hence, the durability of a coating (the corrosion resistance and the crack resistance under a high temperatures) has been often insufficient when an aluminum alloy that is commercially available as stated above, is used as a substrate. In addition, even when the durability of a coating is sufficient, there have been problems in that, because elements that have been added into the aluminum alloy substrate and impurity elements are contained in the coating, and because these elements are emitted in the gas from the coating, members to be treated are contaminated.

On the other hand, from a point of view of reducing the contamination of members to be treated, many aluminum alloys have been proposed as materials for substrates on which an anodic oxidation treatment is performed, in which Mg and Si are added into a highly pure aluminum and contents of impurities are reduced as less as possible (see, for example, Patent Documents 8 to 14).

Further, as an aluminum alloy substrate on which a coating excellent in the durability can be formed, substrates have been proposed in which Mn, Cu, and Fe in addition to Mg and Si are added into a highly pure aluminum (see, Patent Documents 15 and 16). However, because Cu and Fe, which could be contamination sources, are contained in the above aluminum alloy substrates, a sufficient effect cannot be expected for reducing the contamination of members to be treated, and there is also a problem in that the durability of the coating is insufficient under current gaseous environments adopted. In addition, there has been a problem in that the growth rate of an anodic oxidation coating is very slow on the aluminum alloys, resulting in the poor productivity.

[Patent Document 1] Japanese Patent No. 2900822

[Patent Document 2] Japanese Patent No. 2943634

[Patent Document 3] Japanese Patent No. 2900820

[Patent Document 4] Japanese Patent Laid-Open No. Hei 11-1797

[Patent Document 5] Japanese Patent Laid-Open No. Hei 11-140690

[Patent Document 6] Japanese Patent Laid-Open No. Hei 11-229185

[Patent Document 7] Japanese Translation of Unexamined PCT application No. 2000-282294

[Patent Document 8] Japanese Patent No. 3249400

[Patent Document 9] Japanese Patent Laid-Open No. 2004-99972

[Patent Document 10] Japanese Patent Laid-Open No. 2002-241992

[Patent Document 11] Japanese Patent Laid-Open No. 2002-256488

[Patent Document 12] Japanese Patent Laid-Open No. 2003-119539

[Patent Document 13] Japanese Patent Laid-Open No. 2003-119540

[Patent Document 14] Japanese Patent Laid-Open No. 2003-171727

[Patent Document 15] Japanese Patent No. 3746878

[Patent Document 16] Japanese Patent Laid-Open No. 2001-220637

DISCLOSURE OF THE INVENTION

The present invention has been made in view of these problems, and an object of the invention is to provide an aluminum alloy for anodic oxidation treatment and an aluminum alloy member having an anodic oxidation coating, or the like, which are excellent in the durability, the contamination resistance, and the productivity under a hot corrosive environment.

In other words, the present invention relates to the following items (1) to (9):

(1) An aluminum alloy for anodic oxidation treatment that is excellent in the durability, the contamination resistance, and the productivity, the aluminum alloy comprising as alloy elements: 0.1 to 2.0 mass % Mg, 0.1 to 2.0 mass % Si, and 0.1 to 2.0 mass % Mn, wherein each content of Fe, Cr, and Cu is limited to 0.03 mass % or less, and wherein the remainder is composed of Al and inevitable impurities.

(2) An aluminum alloy for anodic oxidation treatment that is excellent in the durability, the contamination resistance, and the productivity, wherein the aluminum alloy can be obtained by subjecting an aluminum alloy ingot which comprises as alloy elements 0.1 to 2.0 mass % Mg, 0.1 to 2.0 mass % Si, and 0.1 to 2.0 mass % Mn, and each content of Fe, Cr, Cu is limited to 0.03 mass % or less, and the remainder is composed of Al and inevitable impurities, to a homogenization treatment at a temperature of 500° C. or more to 600° C. or less.

(3) A method for producing an aluminum alloy for anodic oxidation treatment that is excellent in the durability, the contamination resistance, and the productivity, the method comprising: subjecting an aluminum alloy ingot, which comprises as alloy elements 0.1 to 2.0 mass % Mg, 0.1 to 2.0 mass % Si, and 0.1 to 2.0 mass % Mn, and each content of Fe, Cr, Cu is limited to 0.03 mass % or less, and the remainder is composed of Al and inevitable impurities, to a homogenization treatment at a temperature of 500° C. or more to 600° C. or less.

(4) The aluminum alloy according to the item (2), wherein the homogenization temperature is more than 550° C. to 600° C. or less.

(5) The method for producing an aluminum alloy according to item (3), wherein the homogenization temperature is more than 550° C. to 600° C. or less.

(6) The aluminum alloy according to item (1), wherein the aluminum alloy further comprises 0.01 to 0.03 mass % Ti as an alloy element.

(7) The aluminum alloy according to item (2), wherein the aluminum alloy ingot further comprises 0.01 to 0.03 mass % Ti as an alloy element.

(8) An aluminum alloy member comprising the aluminum alloy according to item (1) and an anodic oxidation coating formed on the surface of the aluminum alloy.

(9) A plasma processing apparatus in which a certain treatment is performed on a member to be treated by converting a gas into plasmas inside a vacuum chamber, wherein the vacuum chamber and/or one or more of components equipped inside the vacuum chamber is composed of the aluminum alloy member according to item (8).

According to the aluminum alloy and the aluminum alloy member directed to the present invention, an anodic oxidation coating excellent in the durability, the contamination resistance, and the productivity can be obtained, allowing the aluminum alloy and the aluminum alloy member to be used preferably under a hot corrosive gas environment or a plasma environment. In addition, according to the plasma processing apparatus directed to the present invention, the remarkably low contamination of a member to be treated can be realized in the plasma processing, leading to an improved yield in the production of the members to be treated.

BEST MODE FOR CARRYING OUT THE INVENTION

Figure 1:
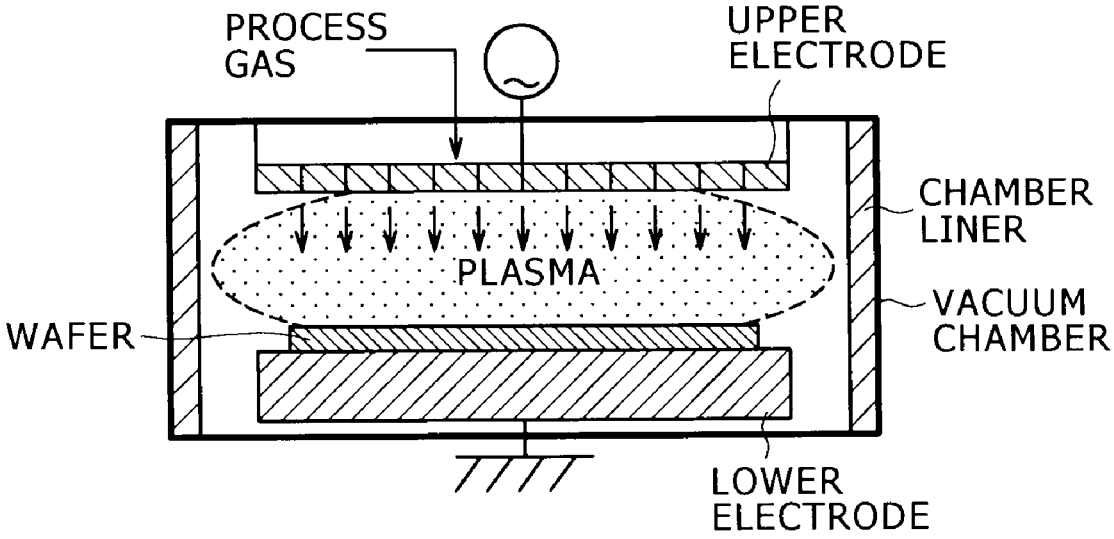
FIG. 1 is a cross-sectional view illustrating an outline structure of the plasma processing apparatus directed to an embodiment of the present invention.
Figure 2:
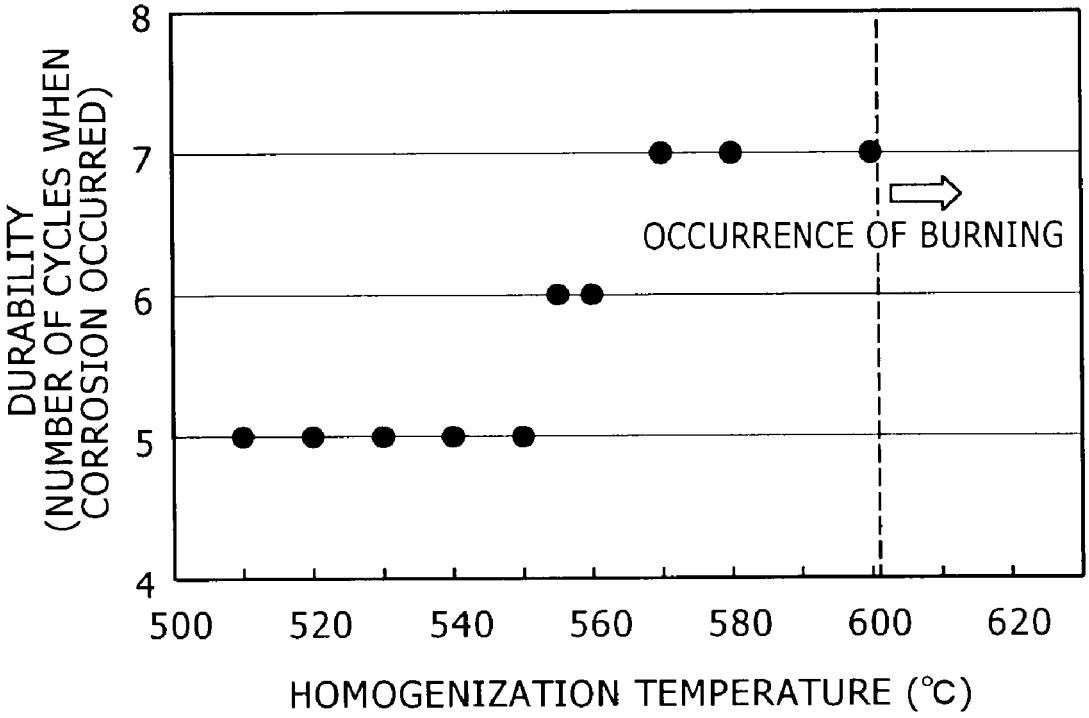
FIG. 2 is a graph illustrating a relation between homogenization temperatures and the durability.

The present inventors have conducted an intensive research on elements or compounds replacing Cu, an element conventionally believed to be an essential additive element for forming an anodic oxidation coating having the durability (see above Japanese Patent No. 3746878 and Japanese Patent Laid-Open No. 2001-220637), because Cu has become impossible to be used from a viewpoint of the low contamination of a member to be treated; and as a result of that, it has been found that an anodic oxidation coating excellent in the durability can be formed by an alloy constituted with Mg, Si, and Mn being major additive elements.

The mechanism by which Mg, Si, and Mn present in a substrate have an effect on the durability of an anodic oxidation coating, is currently under intensive investigation; and so far, it can be inferred that a coating excellent in the durability is formed by an Al—Mn—Si compound or an Al—Mn compound being further combined with $Mg_2Si$, a compound conventionally known for forming an anodic oxidation coating excellent in the durability.

In addition, as a result of an intensive investigation on contents of elements contained in an aluminum alloy, it has been found that the desired durability can be provided by forming an anodic oxidation coating on an aluminum alloy, a substrate, which is obtained by performing a homogenization treatment on an aluminum alloy ingot that comprises as alloy elements 0.1 to 2.0 mass % Mg, 0.1 to 2.0 mass % Si, and 0.1 to 2.0 mass % Mn, wherein each content of Fe, Cr, Cu is limited to 0.03 mass % or less, and wherein the remainder is composed of Al and inevitable impurities. Moreover, it has been proved that the contamination due to a coating itself can also be effectively reduced, because all of Fe, Cr, Cu, and other impurities (inevitable impurities) are limited in contents. In addition, it has also been proved that the growth rate of a coating can be improved by limiting the contents of Fe, Cr, and Cu.

The present invention has been completed based on the above findings; and a description of the reason for limiting the elements of the aluminum alloy directed to the present invention, will be made at first. It is noted that herein all percentages are defined by mass, unless otherwise indicated; and all percentages defined by mass are the same with those by weight.

(Reason for Limiting Elements of Aluminum Alloy)

(Mn: 0.1 to 2%)

Mn is an essential element for forming an Al—Mn—Si Compound or an Al—Mn compound, and when the content of Mn is less than 0.1%, these compounds are hardly formed, resulting in that the desired effect of improving the durability of a resultant anodic oxidation coating, cannot be obtained. On the other hand, when the content of Mn is more than 2.0%, the above compounds become coarse, resulting in that, on the contrary, the formation of a normal anodic oxidation coating is prevented. Therefore, the minimum content of Mn should be 0.1%, preferably 0.4%, more preferably 0.7, and the maximum content thereof should be 2.0%, preferably 1.6%, more preferably 1.2%, (Mg: 0.1 to 2.0%)

Mg is a necessary element for forming an $Mg_2Si$ compound, and when the content of Mg is less than 0.1%, an $Mg_2Si$ compound is hardly formed, resulting in that the desired effect of improving the durability cannot be obtained. On the other hand, when the content of Mg is more than 2.0%, an $Mg_2Si$ compound becomes coarse, resulting in that, on the contrary, the formation of a normal anodic oxidation coating is prevented. Therefore, the minimum content of Mg should be 0.1%, preferably 0.4%, more preferably 0.7%, and the maximum content thereof should be 2.0%, preferably 1.6%, more preferably 1.2%.

(Si: 0.1 to 2.0%)

Si is a necessary element for forming an $Mg_2Si$ compound along with Mg, and when the content of Si is less than 0.1%, the compound is hardly formed, resulting in that the desired effect of improving the durability cannot be obtained. On the other hand, when the content of Si is more than 2.0%, an $Mg_2Si$ compound becomes coarse, resulting in that, on the contrary, the formation of a normal anodic oxidation coating is prevented. Therefore, the minimum content of Mg should be 0.1%, preferably 0.4%, more preferably 0.7%, and the maximum content thereof should be 2.0%, preferably 1.6%, more preferably 1.2%.

(Fe, Cr, Cu: 0.03° C. % or Less, Respectively)

The electricity used in an anodic oxidation treatment is utilized for both ionization of aluminum and generation of oxygen by electrolysis of water, hence, as the ratio of the electricity utilized for the generation of oxygen becomes larger, the ratio thereof utilized for the ionization of aluminum becomes smaller, resulting in that the efficiency of forming an aluminum oxide is decreased followed by a decreased growth rate of the coating. When Fe, Cr, or Cu is present in an aluminum alloy, these elements become starting points of generating oxygen to increase the ratio of electricity utilized for generation of oxygen, resulting in a decreased growth rate of a coating. Further, when any one of the contents of Fe, Cr, or Cu is more than 0.03%, the element is emitted from the mother material and the anodic oxidation coating into the gas, resulting in the contamination of a member to be treated, such as a semiconductor. Therefore, each content of Fe, Cr, and Cu should be set to 0.03% or less, preferably 0.01% or less, respectively.

(Remainder of Al and Inevitable Impurities)

The remainder should be substantially only Al; however, it is accepted that impurity elements, such as Ni, Zn, B, Ca, Na, and K or the like, other than Fe, Cr, and Cu, are inevitably contained in small amounts. In order to realize the lower contamination, it is preferable that the total amount of the impurity elements other than Fe, Cr, and Cu (inevitable impurities) should be set to 0.1% or less.

When the crystal grain size of an alloy is large, a crystalline pattern appears on the anodic oxidation coating to make the color tone uneven; hence, Ti may be contained to prevent this. When the content of Ti is too small, the effect of controlling the crystal grain size cannot be obtained, and when the content is too large, it causes the contamination, on the contrary; therefore, in the case where Ti is contained, the minimum content of Ti is preferably 0.01%, and the maximum content thereof preferably 0.03%, more preferably 0.025%.

(Method for Producing Aluminum Alloy and Aluminum Alloy Member)

Next, a description of a method for producing an aluminum alloy and an aluminum alloy member directed to the present invention, will be made.

An aluminum alloy directed to the present invention is produced by performing a normal melt casting process, which is appropriately selected from, for example, the continuous casting rolling process and the semi-continuous casting process (DC casting process) or the like, on an aluminum alloy ingot of which elements are adjusted within the above content-ranges. The aluminum alloy ingot is subsequently subjected to a homogenization heat treatment (also referred to as a "homogenized heat treatment"). An anodic oxidation coating excellent in the durability can be obtained with a homogenization temperature (also referred to as a "homogenization treatment temperature" or "homogenized treatment temperature") being 500° C. or more; and an anodic oxidation coating more excellent in the durability can be obtained with a homogenization temperature being more than 550° C. However, when a homogenization treatment is performed at a temperature of more than 600° C., a burning or the like sometimes occur, resulting in a failure in the surface quality or the like (see Example 2 described later). Accordingly, it is recommended that a homogenization temperature should be within a range of 500° C. or more (preferably more than 550° C.) to 600° C. or less. It is yet to be known how a homogenization temperature affects the formation of an anodic oxidation coating excellent in the durability; however, it is believed that, as stated above, the formation of an Al—Mn—Si compound or an Al—Mn compound is involved in it.

An aluminum alloy substrate directed to the present invention can be produced by: subjecting the aluminum alloy ingot that has been subjected to a homogenization treatment, to the appropriate deformation processing, such as rolling, forging, and extrusion, to obtain an aluminum alloy member; subjecting the aluminum alloy member to a solution treatment, a quenching treatment, and an artificial aging treatment (hereinafter, simply referred to as an "aging treatment"); and subjecting it to a machining process so as to be formed into an appropriate shape. Alternatively, an aluminum alloy substrate may be produced by: subjecting the above aluminum alloy member to a forming process so as to be formed into a certain shape; and subjecting it to a solution treatment, a quenching treatment, and an aging treatment. As for a solution treatment, a quenching treatment, and an aging treatment, for example, a solution treatment at 515 to 550° C., which is a normal T6 treatment, a water quenching treatment, an aging treatment at 170° C. for 8 hours and at 155 to 165° C. for 18 hours, can be performed.

An aluminum alloy member directed to the present invention is produced by forming an anodic oxidation coating on the aluminum alloy substrate. As for a method for forming an anodic oxidation coating, an anodic oxidation coating can be formed by appropriately selecting the electrolysis conditions, such as the composition and concentration of an electrolytic dissolution, and the electrolysis conditions (voltage, current density, current-voltage waveform) or the like. As for a solution for an anodic oxidation treatment, it is necessary that the electrolysis is performed by using a solution containing one or more elements selected from the group consisting of C, S, N, P, and B. It is an effective way that an aqueous solution containing, for example, one or more compounds selected from the group consisting of oxalic acid, formic acid, sulfamic acid, phosphoric acid, phosphorous acid, boracic acid, nitric acid or compound thereof, and phthalic acid or compound thereof, is used. The thickness of an anodic oxidation coating is not particularly limited to, but is preferably about 0.1 to 200 μm, more preferably about 0.5 to 70 μm, still more preferably about 1 to 50 μm.

The aluminum alloy member is suitable for various applications used under a hot corrosive environment, in particular, is preferably used for: a vacuum chamber, which is exposed to corrosive gases and plasmas under a hot environment, and on the other hand, in which a member to be treated is required to be less contaminated, and which is used in a plasma processing apparatus attached to the semiconductor production equipment or the like; and components equipped inside the vacuum chamber, such as electrode or the like. For example, the above aluminum alloy member can be applied to the whole or part of the vacuum chamber, the chamber liner, the upper electrode, or the lower electrode, which are shown in FIG. 1 illustrating an example of the structure of a plasma processing apparatus.

EXAMPLE

Hereinafter, the present invention will be described in detail with reference to examples; however, the following examples are not intended to limit the invention, and the invention can be practiced with appropriate modifications being made within the scope not departing from the spirit of the invention stated above and later, and those modifications should be included within the scope of the present invention.

Example 1

(Evaluation Test Method)

The following evaluation tests were carried out to establish the effects of the present invention. An aluminum alloy ingot having the element composition shown in the following Table 1 was produced (size: 220 mm W×250 mm L×100 mm t, cooling rate: 10 to 15° C./s). After cutting and facing the ingot (size: 220 mm W×150 mm L×60 mm t), the material was subjected to a homogenization treatment (540° C.×4 h); subsequently, the material having a thickness of 60 mm was subjected to the hot-rolling to be formed into a sheet material having a thickness of 6 mm. After being subjected to a solution treatment (510 to 520° C.×30 min), the sheet material was subjected to a water quenching and an aging treatment (160 to 180° C.×8 h) to obtain an alloy sheet for the test. Test specimens having a size of 25 mm×35 mm (hot-rolling direction)×3 mm t, were cut out from the alloy sheet, of which surface was subsequently subjected to a facing process so as to have a surface roughness Ra of 1.6. Then, after being immersed in 60° C.-10% NaOH aqueous solution, the test specimens were washed with water, and subsequently were immersed in 30° C.-20% $HNO_3$ aqueous solution for 2 minutes, then washed with water to make the surfaces thereof clean. The specimens were then subjected to an anodic oxidation treatment. As the conditions for the anodic oxidation treatment, 16° C.-4% oxalic acid was adopted as a treatment solution; an electrolysis voltage was continuously increased from 10 V to 90V such that the pore sizes of the anodic oxidation coating were 10 nm on the surface side and 110 nm on the substrate side; and treatment time was adjusted such that the thickness of the coating was 25 nm. A growth rate of the coating was evaluated by the time when the thickness of the coating became 25 nm, in accordance with the following standard.

(Growth Rate of Coating)

A: 2 hours or less, B: more than 2 hours to 3 hours or less, C: more than 3 hours to 4 hours or less In order to evaluate the durability of the specimens (aluminum alloy member) created in the above manner, after remaining under a 5% $Cl_2$—Ar gas environment (400° C.) for 4 hours, the specimens were observed whether the corrosion occurred or not, with visual observation (see Japanese Patent Laid-Open No. 2003-34894). Assuming the above procedure was 1 cycle, the procedure was repeated until when the occurrence of the corrosion was observed. The durability was evaluated by the number of the cycles when the corrosion was observed first, in accordance with the following standard.

(Standard for Durability Evaluation)

a: 5 cycles, b: 4 cycles, c: 3 cycles, d: 2 cycles or less

In order to evaluate the contamination resistance of the specimens (aluminum alloy member), an anodic oxidation coating was dissolved in 100 mL of 7% HCl (herein, "mL" means "milliliter") to an extent where the substrates were not exposed, and then an amount of dissolution W(g) of the anodic oxidation coating was determined from the weight changes of the HCl between before and after the dissolution. Subsequently, the HCl solution was subjected to an ICP analysis to determine each content of Fe, Cr, and Cu in the HCl solution; and each weight of Fe, Cr, and Cu dissolved in 100 mL of the HCl solution (WFe, WCr, WCu (g)) were calculated. Each content of Fe, Cr, and Cu in the anodic oxidation coating was determined from WFe/W, WCr/W, and WCu/W; and the contamination resistance was evaluated by the each content of Fe, Cr, and Cu in the anodic oxidation coating, in accordance with the following standard.

(Standard for Contamination Resistance Evaluation)

1: any content of the elements 500 ppm or less; 2: at least one content of the elements more than 500 ppm to 1500 ppm or less; other content thereof 500 ppm or less; 3: at least one content of the elements more than 1500 ppm.

(Results of Evaluation Tests)

The results of the evaluation tests were jointly shown in Table 1. As is obvious from the table, with Examples Nos. 4 to 19 and 32 to 40, which satisfy the content-ranges specified by the present invention, excellent results can be obtained in the durability, the contamination resistance, and the growth rate of the coating.

On the other hand, as obvious from Table 1, Comparative Examples Nos. 1 to 3 and 20 to 31 are inferior to Examples according to the present invention in any one or two of the durability, the contamination resistance, and the growth rate of the coating.

More specifically, Comparative Examples Nos. 1 to 3 and 20 to 22 are out of the content-ranges specified by the present invention in anyone of the contents of Mg, Si, and Mn; and the durability is inferior while the growth rate of the coating and the contamination resistance are excellent.

Comparative Examples Nos. 23 to 31 are beyond the maximum of the content-ranges specified by the present invention in any one of the contents of Fe, Cr, and Cu; and the growth rate of the coating and the contamination resistance are inferior while the durability is excellent.

TABLE 1

| No. | | Element Composition (Mass) | | | | | | Durability | Growth Rate of Coating | Contamination Resistance |
|---|---|---|---|---|---|---|---|---|---|---|
| | | Mg | Si | Mn | Fe | Cr | Cu | | | |
| 1 | Comparative Example | 2.1 | 0.8 | 1.0 | 0.007 | 0.009 | 0.008 | d | A | 1 |
| 2 | Comparative Example | 1.1 | 0.9 | 2.1 | 0.009 | 0.008 | 0.007 | d | A | 1 |
| 3 | Comparative Example | 1.0 | 2.1 | 0.8 | 0.008 | 0.006 | 0.009 | d | A | 1 |
| 4 | Example | 0.8 | 1.1 | 2.0 | 0.008 | 0.008 | 0.009 | c | A | 1 |
| 5 | Example | 1.0 | 2.0 | 0.9 | 0.007 | 0.006 | 0.008 | c | A | 1 |
| 6 | Example | 2.0 | 0.8 | 1.0 | 0.009 | 0.007 | 0.008 | c | A | 1 |
| 7 | Example | 1.6 | 1.0 | 1.2 | 0.009 | 0.007 | 0.008 | b | A | 1 |
| 8 | Example | 0.8 | 1.2 | 1.6 | 0.008 | 0.009 | 0.007 | b | A | 1 |
| 9 | Example | 1.0 | 1.6 | 1.1 | 0.006 | 0.006 | 0.009 | b | A | 1 |
| 10 | Example | 0.7 | 1.0 | 1.2 | 0.009 | 0.007 | 0.008 | a | A | 1 |
| 11 | Example | 1.0 | 0.7 | 1.0 | 0.008 | 0.008 | 0.007 | a | A | 1 |
| 12 | Example | 1.2 | 1.2 | 0.7 | 0.007 | 0.006 | 0.009 | a | A | 1 |

TABLE 1-continued

| No. | | Element Composition (Mass) Mg | Si | Mn | Fe | Cr | Cu | Durability | Growth Rate of Coating | Contamination Resistance |
|---|---|---|---|---|---|---|---|---|---|---|
| 13 | Example | 1.0 | 0.9 | 0.9 | 0.009 | 0.009 | 0.008 | a | A | 1 |
| 14 | Example | 1.0 | 0.4 | 1.2 | 0.009 | 0.007 | 0.009 | b | A | 1 |
| 15 | Example | 0.8 | 0.9 | 0.4 | 0.006 | 0.009 | 0.007 | b | A | 1 |
| 16 | Example | 0.4 | 0.7 | 1.0 | 0.007 | 0.008 | 0.006 | b | A | 1 |
| 17 | Example | 1.2 | 0.1 | 1.0 | 0.007 | 0.008 | 0.006 | c | A | 1 |
| 18 | Example | 0.1 | 1.0 | 0.8 | 0.009 | 0.007 | 0.008 | c | A | 1 |
| 19 | Example | 1.1 | 0.9 | 0.1 | 0.007 | 0.009 | 0.007 | c | A | 1 |
| 20 | Comparative Example | 0.09 | 0.8 | 1.1 | 0.006 | 0.008 | 0.009 | d | A | 1 |
| 21 | Comparative Example | 1.0 | 0.08 | 0.7 | 0.009 | 0.007 | 0.008 | d | A | 1 |
| 22 | Comparative Example | 0.9 | 1.1 | 0.09 | 0.008 | 0.009 | 0.006 | d | A | 1 |
| 23 | Comparative Example | 0.9 | 1.0 | 0.9 | 0.052 | 0.008 | 0.007 | a | C | 3 |
| 24 | Comparative Example | 1.0 | 1.0 | 0.9 | 0.009 | 0.053 | 0.008 | a | C | 3 |
| 25 | Comparative Example | 1.0 | 0.9 | 0.9 | 0.009 | 0.008 | 0.051 | a | C | 3 |
| 26 | Comparative Example | 0.9 | 1.0 | 0.9 | 0.049 | 0.008 | 0.007 | a | C | 2 |
| 27 | Comparative Example | 1.0 | 1.0 | 0.9 | 0.009 | 0.050 | 0.008 | a | C | 2 |
| 28 | Comparative Example | 1.0 | 0.9 | 0.9 | 0.009 | 0.008 | 0.048 | a | C | 2 |
| 29 | Comparative Example | 0.9 | 1.0 | 0.9 | 0.031 | 0.007 | 0.008 | a | C | 2 |
| 30 | Comparative Example | 1.0 | 1.0 | 0.9 | 0.008 | 0.032 | 0.009 | a | C | 2 |
| 31 | Comparative Example | 1.0 | 0.9 | 0.9 | 0.007 | 0.009 | 0.031 | a | C | 2 |
| 32 | Example | 0.9 | 1.0 | 0.9 | 0.029 | 0.007 | 0.008 | a | B | 1 |
| 33 | Example | 0.9 | 0.9 | 1.0 | 0.009 | 0.030 | 0.007 | a | B | 1 |
| 34 | Example | 1.0 | 1.0 | 0.9 | 0.009 | 0.009 | 0.030 | a | B | 1 |
| 35 | Example | 0.9 | 1.0 | 0.9 | 0.012 | 0.008 | 0.007 | a | B | 1 |
| 36 | Example | 1.0 | 1.0 | 0.9 | 0.009 | 0.011 | 0.008 | a | B | 1 |
| 37 | Example | 1.0 | 0.9 | 0.9 | 0.009 | 0.008 | 0.011 | a | B | 1 |
| 38 | Example | 0.9 | 1.0 | 0.9 | 0.010 | 0.008 | 0.009 | a | A | 1 |
| 39 | Example | 1.0 | 1.0 | 0.9 | 0.008 | 0.009 | 0.009 | a | A | 1 |
| 40 | Example | 1.0 | 0.9 | 1.0 | 0.007 | 0.008 | 0.010 | a | A | 1 |

Note:
Numbers with underline are out of the ranges specified by the present invention.

Example 2

In the above Example 1, the effect by the element composition of the aluminum alloy ingot was investigated with a homogenization temperature being constant (540° C.), and with the element composition of the aluminum alloy ingot being changed to various modes. In the present Example, the effect of a homogenization temperature on each property of the aluminum alloy, such as the durability, was investigated with the element composition of the aluminum alloy being fixed to a constant value within the content-ranges specified by the present invention, and with a homogenization temperatures being changed. That is, a homogenization temperature was sequentially changed within a range of 510 to 605° C., while the element composition of the aluminum alloy was fixed to that listed in the following Table 2 (equivalent to No. 13 in Example 1). Other than that, the evaluation tests were carried out on the same conditions as those of Example 1.

TABLE 2

| Element Composition (Mass) Mg | Si | Mn | Fe | Cr | Cu |
|---|---|---|---|---|---|
| 1.0 | 0.9 | 0.9 | <0.01 | <0.01 | <0.01 |

As a result, it was confirmed that the durability was remarkably increased when a homogenization temperature was greater than 550° C. When a homogenization temperature was more than 600° C., the occurrence of a burning was observed on specimens.

With respect to the growth rate of a coating and the contamination resistance, almost constant evaluation results were obtained within the range of a homogenization temperature of the present Example, regardless of a homogenization temperature; thereby, it can be confirmed that the excellent growth rate of a coating and contamination resistance, which are the same level as with Example No. 13 in the above Example 1, can be obtained.

The present invention has been described in detail with reference to the specific embodiments, and it is readily apparent to those skilled in the art that various changes and modifications may be made without departing from the sprit and the scope of the present invention. The present application is based on Japanese Patent Application Laid-Open 2006-220387 filed Aug. 11, 2006, the disclosure of which is incorporated herein by reference in its entirety. All references cited herein are incorporated herein by reference in their entirety.

INDUSTRIAL APPLICABILITY

According to the aluminum alloy and the aluminum alloy member directed to the present invention, an anodic oxidation coating excellent in the durability, the contamination resistance, and the productivity, can be obtained, allowing the aluminum alloy and the aluminum alloy member to be used preferably under a hot corrosive gas environment or a plasma environment. According to the plasma processing apparatus of the invention, the remarkably low contamination of members to be treated can be realized in the plasma processing, leading to an increased yield in the production of the members to be treated.

The invention claimed is:

1. A vacuum chamber or a component inside a vacuum chamber, comprising an aluminum alloy consisting essentially of:

greater than 0.8 to 2.0 mass % Mg,
0.1 to 2.0 mass % Si,
0.1 to 2.0 mass % Mn,
from 0 to 0.03 mass % Fe,
from 0 to 0.03 mass % Cr,
from 0 to 0.03 mass % Cu,
Al, and
inevitable impurities,
wherein at least one content selected from the group consisting of a content of Fe, a content of Cr, and a content of Cu, is or are individually 0.01 mass % or less.

2. The vacuum chamber or component according to claim 1, wherein the content of Fe in the aluminum alloy is 0.01 mass % or less.

3. The vacuum chamber or component according to claim 2, wherein the content of Cr in the aluminum alloy is 0.01 mass % or less.

4. The vacuum chamber or component according to claim 3, wherein the content of Cu in the aluminum alloy is 0.01 mass % or less.

5. The vacuum chamber or component according to claim 2, wherein the content of Cu in the aluminum alloy is 0.01 mass % or less.

6. The vacuum chamber or component according to claim 1, wherein the content of Cr in the aluminum alloy is 0.01 mass % or less.

7. The vacuum chamber or component according to claim 6, wherein the content of Cu in the aluminum alloy is 0.01 mass % or less.

8. The vacuum chamber or component according to claim 1, wherein the content of Cu in the aluminum alloy is 0.01 mass % or less.

9. The vacuum chamber or component according to claim 1, wherein the vacuum chamber is present and further comprises an electrode.

10. The vacuum chamber or component according to claim 1, wherein the vacuum chamber is present and further comprises an upper electrode and a lower electrode.

11. The vacuum chamber or component according to claim 1, further comprising an anodic oxidation coating on a surface of the aluminum alloy.

12. A plasma processing apparatus, comprising:

the vacuum chamber or component of claim 11,
wherein the apparatus is suitable for performing a certain treatment on a member by converting a gas into a plasma inside the vacuum chamber or inside a vacuum chamber comprising the component.

13. The aluminum alloy member according to claim 11, wherein a thickness of the anodic oxidation coating is 0.1 to 200 μm.

14. A method of producing the vacuum chamber or component of claim 1, the method comprising:

subjecting an aluminum alloy ingot to a homogenization treatment at a temperature of 500° C. or more to 600° C. or less.

15. The method for producing an aluminum alloy according to claim 14, wherein the temperature of the homogenization treatment is more than 550° C. to 600° C. or less.

16. A vacuum chamber or a component inside a vacuum chamber, comprising an aluminum alloy obtained by a process comprising subjecting an aluminum alloy ingot to a homogenization treatment at a temperature of 500° C. or more to 600° C. or less, wherein the ingot consists essentially of greater than 0.8 to 2.0 mass % Mg, 0.1 to 2.0 mass % Si, 0.1 to 2.0 mass % Mn, from 0 to 0.03 mass % Fe, from 0 to 0.03 mass % Cr, from 0 to 0.03 mass % Cu, Al, and inevitable impurities; and
wherein at least one content selected from the group consisting of a content of Fe, a content of Cr, and a content of Cu, is or are individually 0.01 mass % or less.

17. The vacuum chamber or component according to claim 16, wherein the temperature of the homogenization treatment is more than 550° C. to 600° C. or less.

18. The vacuum chamber or component according to claim 16, further comprising an anodic oxidation coating on a surface of the aluminum alloy.

19. A vacuum chamber or component inside a vacuum chamber comprising an aluminum alloy, consisting essentially of:

greater than 0.8 to 2.0 mass % Mg,
0.1 to 2.0 mass % Si,
0.1 to 2.0 mass % Mn,
0.01 to 0.03 mass % Ti,
from 0 to 0.03 mass % Fe,
from 0 to 0.03 mass % Cr,
from 0 to 0.03 mass % Cu, Al, and
inevitable impurities,
wherein at least one content selected from the group consisting of a content of Fe, a content of Cr, and a content of Cu, is or are individually 0.01 mass % or less.

* * * * *